United States Patent [19]

Meares

[11] 4,164,928

[45] Aug. 21, 1979

[54] BASKETBALL TOSSING DEVICE

[76] Inventor: Hurshel Meares, 9877 Grand Teton, Baton Rouge, La. 70814

[21] Appl. No.: 737,188

[22] Filed: Nov. 1, 1976

[51] Int. Cl.[2] ..... F41B 7/00

[52] U.S. Cl. ..... 124/16; 124/41 R; 124/38; 24/3 R; 273/1.5 R

[58] Field of Search ..... 124/16, 26, 38, 37, 124/41 R; 273/1.5 R, 1.5 A; 46/74 A, 74 B, 74 C

[56] References Cited

U.S. PATENT DOCUMENTS

| | | | |
|---|---|---|---|
| 221,694 | 11/1879 | Mulholland | 124/16 |
| 2,001,449 | 5/1935 | Bergstrom | 124/16 |
| 3,191,342 | 6/1965 | Chalmers | 124/16 X |
| 3,455,287 | 7/1969 | Oddo | 124/16 |
| 3,612,027 | 10/1971 | Makino | 124/16 |
| 3,770,272 | 11/1973 | Olivier | 124/37 |

*Primary Examiner*—Richard C. Pinkham
*Assistant Examiner*—William R. Browne
*Attorney, Agent, or Firm*—Roy, Kiesel, Patterson & Abadie

[57] ABSTRACT

A hand-held device for tossing a basketball of standard size and shape, up into the air consistently at the same height is provided having a basketball rest plate attached to a spring-loaded firing assembly which is inside a casing having a firing mechanism assembly for discharging the firing assembly. The firing mechanism assembly includes a pivoted trigger that engages notches on a firing rod which is attached to a basketball support plate.

2 Claims, 3 Drawing Figures

BASKETBALL TOSSING DEVICE

BACKGROUND OF THE INVENTION

1. Field of the Invention

This invention relates to amusement devices and games, and more specifically to a hand-held device to assist in the tossing of a basketball.

2. Prior Art

At the high school, college and professional level one of the most heard complaints by coaches relates to the inconsistency of the referee's basketball toss during a "jump ball" situation.

This inconsistency is a result of many factors, some of which include the inexperience of the referee, the necessity of the referee to dip down before the toss and the necessity to move from between the jumping players immediately following the toss. These movement requirements on the referee result in the basketball being thrown too high or low or off-center from the jumping players.

SUMMARY OF THE INVENTION

Therefore, it is an object of this invention to provide a hand-held device for tossing a basketball up in the air a uniform height each time.

Another object of this invention is to provide a basketball toss device that is easy to use and which will not be distractive to a basketball game referee when not in use.

Other objects and advantages of this invention will become apparent from the ensuing descriptions of the invention.

Accordingly, a hand-held device for tossing a basketball up into the air a pre-determined distance is provided having a rest plate on which the basketball sits attached to a spring-loaded firing assembly connected to a casing structure having a firing mechanism assembly for discharging the spring-loaded firing assembly.

PREFERRED EMBODIMENTS OF THE INVENTION

Figure 2:
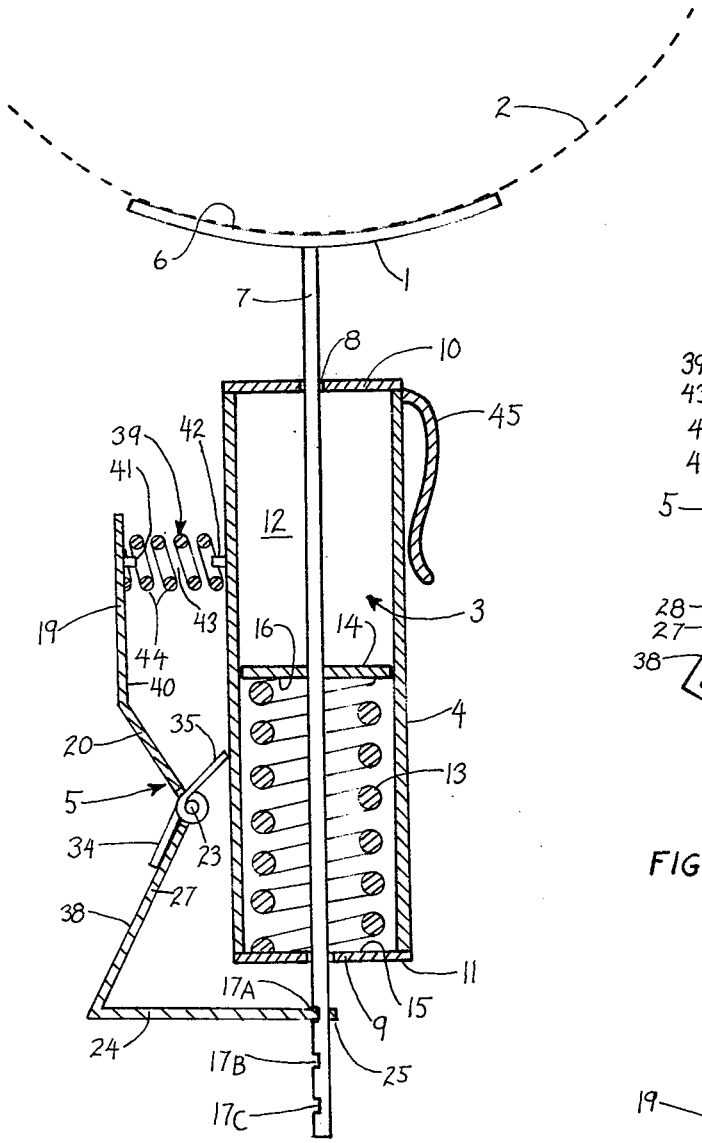
FIG. 2 is a cross-sectional view taken along lines 2—2 of FIG. 1.
Figure 1:
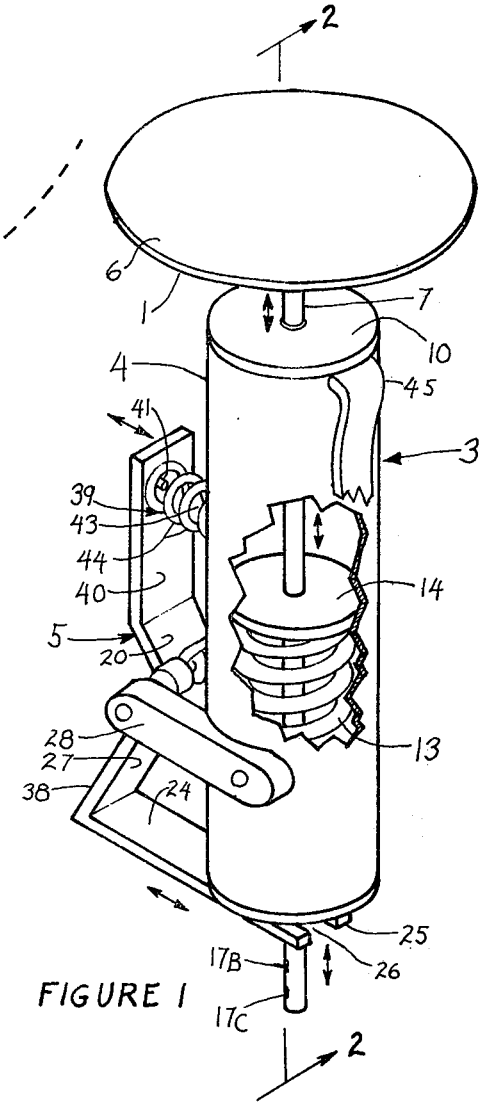
FIG. 1 is a perspective cutaway view of a preferred embodiment of the basketball tossing device of this invention.

As seen in FIGS. 1 and 2, the basketball toss device comprises a ball rest plate 1 on which basketball 2 rests, a spring-loaded firing assembly (denoted generally by the numeral 3), casing structure 4 which can be held in the hand, and a firing mechanism assembly (denoted generally by the numeral 5).

Ball rest plate 1 is preferably a circular plate having a concave surface 6 on which basketball 2 can rest. Most preferably, the curvature of surface 6 will be identical to basketball 2 in order that basketball 2 will more easily rest stably on plate 1. Attached to plate 1 is firing rod 7 of firing assembly 3 which extends through openings 8 and 9 of end walls 10 and 11, respectively, of casing 4 as shown, and is provided with notches 17*a*, 17*b* and 17*c*, at least one of which will extend below end wall 11 when spring 13 is compressed to a firing position as explained below. In a preferred feature, notches 17 will extend all around the circumference of firing rod 7 to form grooves. In this manner it will not matter if firing rod 7 rotates somewhat in openings 8 and 9 during firing because it will not be necessary to horizontally align notches 17 with trigger notch 26 during the cocking of the device as described in more detail hereinbelow Also forming part of the firing assembly 3 and located within casing cavity 12 are spring 13 and spring stop plate 14 which is fixedly attached to firing rod 7. Spring 13 fits about firing rod 7 and extends between and contacts end wall surface 15 and stop plate surface 16.

Figure 3:
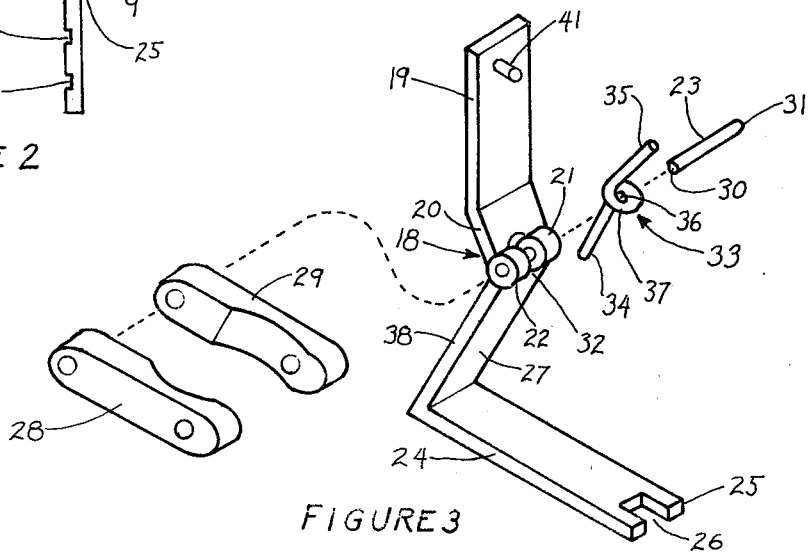
FIG. 3 is an exploded, perspective view illustrating a preferred embodiment of the firing mechanism assembly.

In a preferred embodiment shown in FIG. 3, firing mechanism assembly 5 comprises a trigger 18 having section 19 that extends parallel to casing 4 and is bent at its lower end 20 to pivoting section 21 which has a channel 22 to receive pivoting pin 23. Trigger 18 also has section 24 which extends below and parallel with casing end wall 11. Section 24 is provided at its outward edge 25 with notch 26 which is of sufficient width to fit about the lower end of firing rod 7 and into one of its notches 17. Section 24 connects with pivoting section 21 by section 27 that extends from pivoting section 21 and in a direction away from casing 4 where it attaches to section 24 as shown.

Trigger 18 is attached to casing 4 by support arms 28 and 29 which connect at one end to either end of 30 and 31, respectively, pivoting pin 23 and at the other end to casing 4 by welding or other similar fashion. In a more preferred feature, pivoting section 21 will be provided with opening 32 in which biasing spring pin 31 extends through channel 36 formed by loops 37 of spring 33 to hold spring 33 in position within opening 32. Spring member 34 will extend along and in contact with surface 38 of trigger section 27 while spring member 35 will extend upward and outward to contact casing 4 in a manner to cause spring member 34 to exert a force against surface 38. In this manner, trigger section notch 26 will engage firing rod notch 17 and be held in that position until positive pressure is applied to trigger section 19 as described below.

In an alternate embodiment, spring 33 could be replaced or supplemented by spring 39 which extends between surface 40 of trigger section 19 and casing 4. Spring 39 is held in position by stops 41 and 42 extending outward from surface 40 and casing 4, respectively, and into channel 43 formed by spring coils 44.

In another preferred feature, caniliver-type spring means 45 is attached to casing 4 for use in attaching the basketball toss device to the referee's belt when not in use.

To operate the device, rest plate 1 is pushed down through casing 4 compressing spring 13 until the desired compression force is reached. This can be pre-calculated and should be co-ordinated with the position of notches 17 below casing end wall 11. Trigger section 19 is squeezed toward casing 4 which forces section end 25 away from firing rod 7 to allow firing rod 7 to pass downward to the desired position. Once rod 7 is in the desired position, trigger section 19 is released to allow trigger section notch 26 to fit in firing rod notch 17 to hold the firing mechanism assembly 3 in position for discharging. Next, the basketball 2 is placed in rest plate surface 6 and the device is positioned between the basketball players for discharging the ball into the air. The discharge is simply accomplished by again squeezing trigger section 19 toward casing 4.

By providing different notches 17*a*, 17*b*, and 17*c*, the discharge force can be varied to toss the ball at different heights. This can be very important because of the different heights of the basketball players.

There are, of course, many other alternatives designs and features of this invention, which are meant to be included within the scope of this invention as defined by the following claims.

What I claim is:

1. A hand held device for tossing a basketball of standard size and shape and specific curvature radius up into the air a predetermined distance which comprises:

(a) a rest plate having a surface on which said basketball can sit, said surface having a curvature radius like said specific curvature radius of said basketball;

(b) a casing structure;

(c) a spring-loaded firing assembly attached to said rest plate and connected to said casing structure; said firing assembly having a firing rod provided with notches at pre-determined positions on said firing rod; and (d) a firing mechanism assembly having a trigger pivotably attached to said casing structure and having a notched end section of sufficient width to fit about said firing rod and into one of said firing rod notches.

2. A hand-held device according to claim 1 wherein said firing rod's notches extend completely around the circumference of said firing rod to form a groove.

* * * * *